US007918946B2

(12) United States Patent
Sato

(10) Patent No.: US 7,918,946 B2
(45) Date of Patent: Apr. 5, 2011

(54) FE-BASED AMORPHOUS ALLOY EXCELLENT IN SOFT MAGNETIC PROPERTIES

(75) Inventor: Yuichi Sato, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/449,687

(22) PCT Filed: Dec. 27, 2007

(86) PCT No.: PCT/JP2007/075398

§ 371 (c)(1),
(2), (4) Date: Aug. 20, 2009

(87) PCT Pub. No.: WO2008/105135

PCT Pub. Date: Sep. 4, 2008

(65) Prior Publication Data

US 2010/0096045 A1 Apr. 22, 2010

(30) Foreign Application Priority Data

Feb. 28, 2007 (JP) ..... 2007-048469
Feb. 28, 2007 (JP) ..... 2007-048665
Mar. 2, 2007 (JP) ..... 2007-052507

(51) Int. Cl.
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS

| | | | | |
|---|---|---|---|---|
| 4,400,208 | A * | 8/1983 | Ackermann | 148/403 |
| 4,523,626 | A | 6/1985 | Masumoto et al. | |
| 6,416,879 | B1 | 7/2002 | Sakamoto et al. | |
| 2005/0236071 | A1 * | 10/2005 | Koshiba et al. | 148/304 |
| 2007/0295429 | A1 * | 12/2007 | Yi et al. | 148/403 |

FOREIGN PATENT DOCUMENTS

| | | |
|---|---|---|
| CN | 1356403 | 7/2002 |
| JP | 49-91014 | 8/1974 |
| JP | 57-116750 | 7/1982 |
| JP | 61-30649 | 2/1986 |
| JP | 61-243152 | 10/1986 |
| JP | 62-13555 | 1/1987 |
| JP | 2-60751 | 12/1990 |
| JP | 2002-285304 | 10/2002 |
| JP | 2005-256104 | 9/2005 |

OTHER PUBLICATIONS

International Search Report dated Apr. 22, 2008 issued in corresponding PCT Application No. PCT/JP2007/075398.
Chinese Office Action Dated Jun. 29, 2010 in Chinese Application: 200780050092.2.

* cited by examiner

*Primary Examiner* — John P Sheehan
(74) *Attorney, Agent, or Firm* — Kenyon & Kenyon LLP

(57) ABSTRACT

The invention provides an amorphous alloy with good soft magnetic properties, namely an Fe-based amorphous alloy having excellent soft magnetic properties comprising, in at. %, Fe: 78 to 86%, P: 6 to 20%, C: 2 to 10%, one or both of Si and Al: 0.1 to 5%, and a balance of unavoidable impurities. P or C can as required be partially or totally replaced with B: 1 to 18%.

3 Claims, No Drawings

FE-BASED AMORPHOUS ALLOY EXCELLENT IN SOFT MAGNETIC PROPERTIES

This application is a national stage application of International Application No. PCT/JP2007/075398, filed 27 Dec. 2007, which claims priority to Japanese Application Nos. 2007-048469, filed 28 Feb. 2007; 2007-048665 filed 28 Feb. 2007; and 2007-052507, filed 2 Mar. 2007, each of which is incorporated by reference in its entirety.

FIELD OF THE INVENTION

This invention relates to an Fe-based amorphous alloy thin strip excellent in soft magnetic properties and suitable for use in, for example, the cores of power transformers and high-frequency transformers.

DESCRIPTION OF THE RELATED ART

Among methods for continuously producing thin strip or wire by rapidly cooling an alloy from the molten state are known, for example, the centrifugal rapid cooling method, single roll method and twin roll method. These methods produce sheet or wire by jetting molten metal from an orifice or the like onto the inner or outer surface of a rapidly rotating metal drum, thereby rapidly solidifying the molten metal. By appropriately selecting the alloy composition, it is possible to obtain an amorphous alloy resembling liquid metal and to manufacture a material excellent in magnetic properties and mechanical properties.

Numerous compositions have been proposed for amorphous alloys to be obtained by rapid-cooling solidification in this manner. For example, Japanese Patent Publication (A) No. S49-91014 teaches an alloy composition comprising, in atomic percent (at. %), at least one of Fe, Ni, Cr, Co and V at a content of 60 to 90%, at least one of P, C and B at a content of 10 to 30%, and at least one of Al, Si, Sn, Sb, Ge, In and Be at a content of 0.1 to 15%. The invention of this publication proposes an alloy composition for obtaining an amorphous phase and is not particularly limited to compositions directed solely to so-called magnetic properties useful in the cores and the like of power transformers, high-frequency transformers etc.

Many alloy compositions for amorphous alloys exhibiting desired magnetic properties have also been proposed. For example, Japanese Patent Publication (A) No. S57-116750 teaches an alloy composition comprising, in at. %, Fe: 75-78.5%, Si: 4-10.5%, and B: 11-21%.

Further, Japanese Patent Publication (A) No. S61-3064 aches an alloy composition wherein 70-90% of the content of at least one of Fe and Co, 10-30% of the content of at least one of B, C and P, and the content of Fe and Co can be replaced up to ¾ with Ni and up to ¼ with V, Cr, Mn, Mo, Nb, Ta and W, and the content of B, C and P can be replaced up to ⅗ with Si and up to ⅓ with Al.

Among the amorphous alloy compositions proposed by Japanese Patent Publication (A) Nos. S49-91014 and S61-30649, the Fe—Si—B amorphous alloys, such as taught by Japanese Patent Publication (A) No. S57-116750, for example, came to be viewed as promising for application in the cores and the like of power transformers, high-frequency transforms etc. because of, inter alia, their low core loss (energy loss) and high saturation magnetic flux density and permeability, and their ability to establish a stable amorphous phase.

Development of alloy compositions for Fe-based amorphous alloys excellent in soft magnetic properties has since centered on Fe—Si—B alloy systems. That is to say, R&D for further reducing the core loss of Fe—Si—B amorphous alloys has been actively conducted and produced many good results.

However, despite the considerable progress made in reducing amorphous alloy core loss, a strong need continues to be felt for property enhancement in this area of application and further core loss property improvement is desired. Taking core loss at W13/50 (core loss at a flux density of 1.3 T and a frequency of 50 Hz) as an example, reduction to below 0.12 W/kg has so far been achieved but realizing a reduction to or below 0.10 W/kg has proven extremely difficult.

SUMMARY OF THE INVENTION

The present invention responds to the need for such additional improvement of core loss property by providing an amorphous alloy enabling still further core loss reduction.

Among the elements of the various alloy compositions proposed up to now, the inventors focused on the P, C and B elements classified as the second composition group in, for example, Japanese Patent Publication (A) Nos. 549-91014 and S61-30649 discussed in the foregoing and again studied and carried out experiments with respect to combinations of these elements and their contents. As a result of detailed experiments using a basic composition system dominated by P and C and further combining other elements, they discovered an amorphous alloy composition enabling still further core loss reduction, namely of consistently realizing a core loss at W13/50 (core loss at a flux density of 1.3 T and a frequency of 50 Hz) of 0.10 W/kg or less. They accomplished the present invention by conducting studies based on this knowledge.

The present invention is set out below:

(1) An Fe-based amorphous alloy having excellent soft magnetic properties comprising, in at. %, Fe: 78 to 86%, P: 6 to 20%, C: 2 to 10%, and one or both of Si: 0.1 to 5% and Al: 0.1 to 3% in a total of 0.1 to 5%, and a balance of unavoidable impurities.

(2) An Fe-based amorphous alloy having excellent soft magnetic properties comprising the composition of the Fe-based amorphous alloy of (1) and further comprising, in at. %, B: 1 to 18%.

(3) An Fe-based amorphous alloy having excellent soft magnetic properties comprising the composition of the Fe-based amorphous alloy of (1) or (2), wherein Fe is replaced within the range of 30 at. % or less with at least one of Ni, Cr and Co.

By providing an amorphous alloy of reduced core loss, the present invention enables consistent achievement of a core loss at W13/50 of 0.10 W/kg or less as determined by single strip measurement.

DETAILED DESCRIPTION OF THE INVENTION

The invention is explained in detail below.

The present invention is characterized in optimizing the kinds and contents of the constituent elements of an Fe-based alloy by addition of P and C and further selective addition of Si and Al, thereby realizing desired soft magnetic properties, particularly low core loss, consistently within the same lot. In addition, the present invention realizes still further improvement of the soft magnetic properties by replacing part of the base Fe with one or more of Ni, Cr and Co.

The reasons for limiting the contents of the individual elements will be explained first. P and C are added for the purpose of improving amorphous phase formation and amorphous phase thermal stability. Moreover, by optimizing the contents of these elements, it is possible to improve the core loss value even further. For example, a core loss at W13/50 of 0.10 W/kg or less as determined by single strip measurement can be consistently achieved. At a P content of less than 6 at. % or a C content of less than 2 at. %, an amorphous alloy cannot be consistently obtained, so that is difficult consistently to hold core loss to 0.10 W/kg or less. On the other hand, when P content exceeds 20 at. % or C exceeds 10 at. %, an amorphous alloy cannot be consistently obtained, so that it becomes impossible consistently to hold core loss to 0.10 W/kg or less. Therefore, P content is limited to the range of 6 to 20 at. %, preferably 6 to 18 at. %, and C is limited to the range of 2 to 10 at. %.

In the present invention, P and C can be partially or totally replaced with B. In this case, B content is defined as 1 to 18 at. %.

B has an effect of improving amorphous phase formation and amorphous phase thermal stability, and core loss value can be further improved by optimizing B content. At a B content of less than 1 at. %, an amorphous alloy cannot be consistently obtained, so that is difficult consistently to hold core loss to 0.10 W/kg or less. On the other hand, when B content exceeds 18 at. %, an amorphous alloy cannot be consistently obtained, so that it becomes impossible consistently to hold core loss to 0.10 W/kg or less. Therefore, B is desirably added to a content of 1 to 18 at. %, preferably 8 to 18 at. %.

Addition of Si and Al improves amorphous phase formability and further improves amorphous phase thermal stability. These elements exhibit their effect either when one of them is added alone or when they are added together. Their contents are defined as Si: 0.1 to 5 at. %, Al: 0.1 to 3 at. %, and total of 0.1 to 5 at. % No effect is observed at a total content of less than 0.1 at. %, while the effect of the addition diminishes at greater than 5 at. %. Addition within the range of 0.1 to 3 at. % is still more preferable.

A saturation magnetic flux density of a level practical for an ordinary iron core can usually be obtained at an Fe content of 70 at. % or greater. In order to achieve a high saturation magnetic flux density of 1.5 T or greater, the Fe content must be 78 at. % or greater. On the other hand, when the Fe content exceeds 86 at. %, formation of amorphous phase becomes difficult, so that it becomes hard consistently to hold core loss to 0.10 W/kg or less. Fe content is therefore limited to within the range of 78 to 86 at. %

In this invention, partial replacement of Fe within the range of greater than 0 to not greater than 30 at. % with at least one of Ni, Cr and Co makes it possible to improve permeability, flux density and other soft magnetic properties and also consistently to hold core loss at W13/50 to 0.10 W/kg or less. The reason for limiting the amount of replacement with these elements is that raw material cost increases when the replacement exceeds 30 at. %.

A thin strip of the invention amorphous alloy can be produced by a method of melting an alloy of the invention composition and jetting the molten alloy from a slot nozzle or the like onto a rapidly moving cooling plate to rapidly cool and solidify the molten alloy by, e.g., the single roll method or twin roll method. Usable single-roll machines include centrifugal rapid cooling machines that use the inner wall of a drum, machines that use an endless belt, modifications of these machines equipped with an auxiliary roll or a roll surface temperature control unit, and casting machines that cast under reduced pressure or vacuum or in an inert gas. In this invention, the thickness, width and other dimensions of the thin strip are not particularly limited, but the preferable thin strip thickness is, for example, 10 to 100 μm. The strip width is preferably 10 mm or greater.

Examples

The invention is explained further by way of examples in the following.

First Set of Examples

Alloys of the compositions shown in Table 1 were melted in an argon atmosphere and cast into thin strips by the single-roll method. The casting atmosphere was air. The properties of the thin strips were examined. The single-roll thin strip production machine used was equipped with, inter alia, a 300 mm diameter copper alloy cooling roll, a high-frequency power supply for sample melting, and a quartz crucible with a slot nozzle at one end. The slot nozzle used in these Examples measured 20 mm in length and 0.6 mm in width. The peripheral speed of the cooling roll was 24 m/sec. The thickness of the obtained thin strips was about 25 μm and the width thereof, which depended on the length of the slot nozzle, was 20 mm.

The core loss values of the thin strips were determined using an SST (Single Strip Tester). The measurement was conducted under conditions of a magnetic flux density of 1.3 T and frequency of 50 Hz. The core loss measurement was conducted using 120 mm long thin strip samples cut from 12 locations along the full length of each lot. Each thin strip sample was subjected to core loss measurement after annealing in a magnetic field for 1 hr at 360° C. The annealing atmosphere was nitrogen.

As the core loss measurement results, Table 1 shows the maximum value (Wmax), minimum value (Wmin) and deviation value ((Wmax−Wmin)/Wmin) in each lot.

As can be seen from the results for Samples No. 1 to 2 in Table 1, it was found that thin strips excellent in soft magnetic properties over their full length, namely that exhibited core loss at a flux density of 1.3 T and a frequency of 50 Hz of less than 0.10 W/kg and a deviation ((Wmax−Wmin)/Wmin) thereof of less than 0.1, could be obtained by establishing a composition within the range of this invention comprising Fe: 78 to 86 at. %, P: 6 to 18 at. %, C: 2 to 10 at. %, and at least one of Si and Al: 0.1 to 5 at. %.

In contrast, in the composition ranges of Samples No. 22 to 31 indicating Comparative Examples, regions of core loss greater than 0.10 W/kg were present and the deviation ((Wmax−Wmin)/Wmin) came to be greater than 0.1.

As can be seen from the Examples, the present invention enables marked improvement of soft magnetic properties.

TABLE 1

| Sample | No. | Chemical composition (at. %) Fe | P | C | Si | Al | Core loss value (W/kg) Wmax | Wmin | Deviation |
|---|---|---|---|---|---|---|---|---|---|
| Invention Examples | 1 | 78.1 | 17.9 | 2.2 | 1.8 | — | 0.087 | 0.081 | 0.07 |
| | 2 | 79.3 | 16.1 | 3.5 | 1.1 | — | 0.088 | 0.082 | 0.07 |
| | 3 | 80.4 | 14.1 | 4.7 | 0.8 | — | 0.089 | 0.082 | 0.08 |
| | 4 | 81.0 | 6.1 | 10.0 | 2.9 | — | 0.089 | 0.082 | 0.08 |
| | 5 | 81.1 | 9.8 | 8.1 | 1.0 | — | 0.081 | 0.077 | 0.05 |
| | 6 | 81.5 | 9.0 | 7.4 | 2.1 | — | 0.083 | 0.078 | 0.06 |
| | 7 | 81.6 | 10.1 | 4.1 | 4.2 | — | 0.092 | 0.085 | 0.08 |
| | 8 | 82.0 | 10.5 | 2.6 | 4.9 | — | 0.092 | 0.085 | 0.08 |
| | 9 | 83.8 | 10.3 | 3.1 | 2.8 | — | 0.089 | 0.082 | 0.08 |
| | 10 | 84.6 | 12.8 | 2.3 | 0.3 | — | 0.096 | 0.088 | 0.09 |
| | 11 | 85.7 | 12.2 | 2.0 | 0.1 | — | 0.098 | 0.090 | 0.09 |
| | 12 | 78.6 | 15.2 | 4.1 | — | 2.1 | 0.091 | 0.084 | 0.08 |
| | 13 | 81.3 | 14.8 | 3.8 | — | 0.1 | 0.092 | 0.086 | 0.07 |
| | 14 | 82.6 | 6.9 | 9.9 | — | 0.6 | 0.098 | 0.091 | 0.08 |
| | 15 | 83.1 | 10.8 | 5.2 | — | 0.9 | 0.096 | 0.089 | 0.08 |
| | 16 | 84.7 | 12.2 | 2.0 | — | 1.1 | 0.098 | 0.090 | 0.09 |
| | 17 | 78.1 | 8.9 | 8.1 | 1.9 | 3.0 | 0.092 | 0.086 | 0.07 |
| | 18 | 80.5 | 11.8 | 4.0 | 2.4 | 1.3 | 0.089 | 0.082 | 0.08 |
| | 19 | 81.6 | 13.0 | 3.0 | 1.8 | 0.6 | 0.088 | 0.082 | 0.07 |
| | 20 | 82.3 | 10.1 | 6.7 | 0.8 | 0.1 | 0.096 | 0.090 | 0.07 |
| | 21 | 84.1 | 12.1 | 3.5 | 0.1 | 0.2 | 0.099 | 0.092 | 0.08 |
| Comparative Examples | 22 | 77.2 | 17.2 | 1.8 | 3.8 | — | 0.104 | 0.094 | 0.11 |
| | 23 | 80.2 | 5.6 | 9.4 | 4.8 | — | 0.106 | 0.096 | 0.10 |
| | 24 | 79.9 | 9.1 | 10.3 | 0.7 | — | 0.118 | 0.102 | 0.16 |
| | 25 | 81.2 | 9.2 | 3.8 | 5.8 | — | 0.110 | 0.098 | 0.12 |
| | 26 | 86.5 | 9.9 | 3.1 | 0.5 | — | 0.121 | 0.108 | 0.12 |
| | 27 | 80.24 | 15.8 | 3.9 | 0.06 | — | 0.109 | 0.098 | 0.11 |
| | 28 | 80.6 | 11.5 | 2.2 | — | 5.7 | 0.121 | 0.106 | 0.14 |
| | 29 | 80.93 | 14.2 | 4.8 | 0.02 | 0.05 | 0.112 | 0.102 | 0.11 |
| | 30 | 79.8 | 8.1 | 6.5 | 1.0 | 4.6 | 0.119 | 0.104 | 0.14 |
| | 31 | 83.7 | 13.1 | 3.2 | — | — | 0.126 | 0.109 | 0.16 |

Second Set of Examples

The Fe of the alloy shown No. 1 in Table 1 was partially replaced with at least one of Ni, Cr and Co and the alloys of the resulting compositions were used to produce thin strips using the same machine and under the same conditions as in the First Set of Examples. It should be noted that Table 2 shows only the Ni, Cr and Co components of the used alloy compositions, with the remaining common components being omitted. The thickness of the obtained thin strips was about 25 μm. The core losses of the thin strips were evaluated. The samples for core loss evaluation were taken and evaluated in the manner of the First Set of Examples. The results are shown in Table 2. The presentation method in Table 2 is the same as that in Table 1.

As can be seen from the results for Samples No. 1 to 9 in Table 2, it was found that even when Fe was partially replaced within the range of 30 at. % or less with at least one of Ni, Cr and Co, thin strips that consistently exhibited a core loss at W13/50 of less than 0.10 W/kg could be obtained.

TABLE 2

| Sample | No. | Chemical composition (at. %) Ni | Cr | Co | Core loss value (W/kg) Wmax | Wmin | Deviation |
|---|---|---|---|---|---|---|---|
| Invention Examples | 1 | 0.1 | — | — | 0.087 | 0.081 | 0.07 |
| | 2 | 1.2 | — | — | 0.086 | 0.081 | 0.06 |
| | 3 | — | 1.8 | — | 0.088 | 0.082 | 0.07 |
| | 4 | — | — | 4.1 | 0.079 | 0.073 | 0.08 |
| | 5 | 6.1 | 2.1 | — | 0.086 | 0.081 | 0.06 |

TABLE 2-continued

| Sample | No. | Chemical composition (at. %) Ni | Cr | Co | Core loss value (W/kg) Wmax | Wmin | Deviation |
|---|---|---|---|---|---|---|---|
| | 6 | 8.2 | — | 2.5 | 0.080 | 0.075 | 0.07 |
| | 7 | 18.5 | 6.0 | 2.1 | 0.083 | 0.078 | 0.06 |
| | 8 | 20.1 | 7.2 | — | 0.090 | 0.083 | 0.08 |
| | 9 | 29.8 | — | — | 0.092 | 0.086 | 0.07 |

Third Set of Examples

The Fe of the alloy shown No. 12 in Table 1 was partially replaced with at least one of Ni, Cr and Co and the alloys of the resulting compositions were used to produce thin strips using the same machine and under the same conditions as in the First Set of Examples. It should be noted that Table 3 shows only the Ni, Cr and Co components of the used alloy compositions, with the remaining common components being omitted. The thickness of the obtained thin strips was about 25 μm. The core losses of the thin strips were evaluated. The samples for core loss evaluation were taken and evaluated in the manner of the First Set of Examples. The results are shown in Table 3. The presentation method in Table 3 is the same as that in Table 1.

As can be seen from the results for Samples No. 1 to 7 in Table 3, it was found that even when Fe was partially replaced within the range of 30 at. % or less with at least one of Ni, Cr and Co, thin strips that consistently exhibited a core loss at W13/50 of less than 0.10 W/kg could be obtained.

TABLE 3

| Sample No. | | Chemical composition (at. %) Ni | Cr | Co | Core loss value (W/kg) Wmax | Wmin | Deviation |
|---|---|---|---|---|---|---|---|
| Invention Examples | 1 | — | 0.04 | — | 0.091 | 0.084 | 0.08 |
| | 2 | 1.3 | — | — | 0.092 | 0.085 | 0.08 |
| | 3 | — | 1.7 | — | 0.094 | 0.086 | 0.09 |
| | 4 | — | — | 4.0 | 0.081 | 0.075 | 0.08 |
| | 5 | 6.0 | 2.0 | — | 0.092 | 0.084 | 0.09 |
| | 6 | 8.2 | — | 2.4 | 0.083 | 0.077 | 0.08 |
| | 7 | 19.1 | 8.2 | 2.5 | 0.085 | 0.080 | 0.06 |

Fourth Set of Examples

The Fe of the alloy shown No. 19 in Table 1 was partially replaced with at least one of Ni, Cr and Co and the alloys of the resulting compositions were used to produce thin strips using the same machine and under the same conditions as in the First Set of Examples. It should be noted that Table 4 shows only the Ni, Cr and Co components of the used alloy compositions, with the remaining common components being omitted. The thickness of the obtained thin strips was about 25 μm. The core losses of the thin strips were evaluated. The samples for core loss evaluation were taken and evaluated in the manner of the First Set of Examples. The results are shown in Table 4. The presentation method in Table 4 is the same as that in Table 1.

As can be seen from the results for Samples No. 1 to 7 in Table 4, it was found that even when Fe was partially replaced within the range of 30 at. % or less with at least one of Ni, Cr and Co, thin strips that consistently exhibited a core loss at W13/50 of less than 0.10 W/kg could be obtained.

TABLE 4

| Sample No. | | Chemical composition (at. %) Ni | Cr | Co | Core loss value (W/kg) Wmax | Wmin | Deviation |
|---|---|---|---|---|---|---|---|
| Invention Examples | 1 | — | — | 0.01 | 0.088 | 0.081 | 0.09 |
| | 2 | 1.8 | — | — | 0.090 | 0.083 | 0.08 |
| | 3 | — | 2.5 | — | 0.092 | 0.085 | 0.08 |
| | 4 | — | — | 2.1 | 0.081 | 0.075 | 0.08 |
| | 5 | 8.1 | 1.9 | — | 0.091 | 0.084 | 0.08 |
| | 6 | 10.2 | — | 2.5 | 0.083 | 0.076 | 0.09 |
| | 7 | 20.6 | 6.8 | 2.4 | 0.086 | 0.079 | 0.09 |

Fifth Set of Examples

The alloys shown Table 5 are ones having the total amount of P replaced with B and the alloys of the resulting compositions were used to produce thin strips using the same machine and under the same conditions as in the First Set of Examples.

The thickness of the obtained thin strips was about 25 μm. The core losses of the thin strips were evaluated. The samples for core loss evaluation were taken and evaluated in the manner of the First Set of Examples. The results are shown in Table 5. The presentation method in Table 5 is the same as that in Table 1.

As can be seen from the results for Samples No. 1 to 8 in Table 5, it was found that thin strips excellent in soft magnetic properties over their full length, namely that exhibited core loss at a flux density of 1.3 T and a frequency of 50 Hz of less than 0.10 W/kg and a deviation ((Wmax−Wmin)/Wmin) thereof of less than 0.1, could be obtained by establishing a composition within the range of this invention comprising Fe: 78 to 86 at. %, B: 8 to 18 at. %, C: 3 to 10 at. %, Si: 0.1 to 5 at. % and Al: 0.1 to 3 at. %.

TABLE 5

| Sample No. | | Chemical composition (at. %) Fe | B | C | Si | Al | Core loss value (W/kg) Wmax | Wmin | Deviation |
|---|---|---|---|---|---|---|---|---|---|
| Invention Examples | 1 | 78.1 | 15.1 | 5.0 | 1.5 | 0.3 | 0.088 | 0.082 | 0.07 |
| | 2 | 79.0 | 14.4 | 5.4 | 0.7 | 0.5 | 0.087 | 0.081 | 0.07 |
| | 3 | 79.5 | 12.0 | 4.5 | 3.2 | 0.8 | 0.091 | 0.084 | 0.08 |
| | 4 | 80.0 | 11.0 | 5.8 | 0.3 | 2.9 | 0.090 | 0.083 | 0.08 |
| | 5 | 81.0 | 11.7 | 6.0 | 0.9 | 0.4 | 0.087 | 0.080 | 0.09 |
| | 6 | 82.0 | 9.3 | 8.4 | 0.2 | 0.1 | 0.098 | 0.090 | 0.09 |
| | 7 | 84.2 | 9.1 | 5.2 | 1.2 | 0.3 | 0.098 | 0.091 | 0.08 |
| | 8 | 85.6 | 9.5 | 3.1 | 1.4 | 0.4 | 0.099 | 0.091 | 0.09 |

Sixth Set of Examples

The alloys shown Table 6 are ones having the total amount of C replaced with B and the alloys of the resulting compositions were used to produce thin strips using the same machine and under the same conditions as in the First Set of Examples.

As can be seen from the results for Samples No. 1 to 12 in Table 6, it was found that thin strips excellent in soft magnetic properties over their full length, namely that exhibited core loss at a flux density of 1.3 T and a frequency of 50 Hz of less than 0.10 W/kg and a deviation ((Wmax−Wmin)/Wmin) thereof of less than 0.1, could be obtained by establishing a composition within the range of this invention comprising Fe: 78 to 86 at. %, P: 8 to 20 at. %, B: 1 to 12 at. %, and at least one of Si and Al: 0.1 to 5 at. %.

TABLE 6

| Sample No. | | Chemical composition (at. %) Fe | P | B | Si | Al | Core loss value (W/kg) Wmax | Wmin | Deviation |
|---|---|---|---|---|---|---|---|---|---|
| Invention Examples | 1 | 78.0 | 16.1 | 4.2 | 1.7 | — | 0.085 | 0.079 | 0.08 |
| | 2 | 79.0 | 15.1 | 1.0 | 4.9 | — | 0.092 | 0.085 | 0.08 |
| | 3 | 80.1 | 11.4 | 5.8 | 2.7 | — | 0.086 | 0.080 | 0.08 |
| | 4 | 80.7 | 13.1 | 4.1 | 2.1 | — | 0.082 | 0.077 | 0.06 |
| | 5 | 81.2 | 9.6 | 6.0 | 3.2 | — | 0.089 | 0.082 | 0.08 |
| | 6 | 83.7 | 10.6 | 5.1 | 0.6 | — | 0.091 | 0.084 | 0.08 |
| | 7 | 84.2 | 11.2 | 3.3 | 1.3 | — | 0.096 | 0.088 | 0.09 |
| | 8 | 85.8 | 10.1 | 3.0 | 1.1 | — | 0.098 | 0.090 | 0.09 |
| | 9 | 81.8 | 12.8 | 2.7 | — | 2.7 | 0.085 | 0.079 | 0.08 |
| | 10 | 82.7 | 13.3 | 2.1 | — | 1.9 | 0.089 | 0.082 | 0.08 |
| | 11 | 83.0 | 10.3 | 4.5 | 1.3 | 0.9 | 0.096 | 0.088 | 0.09 |
| | 12 | 84.1 | 12.3 | 1.2 | 1.3 | 1.1 | 0.097 | 0.089 | 0.09 |

INDUSTRIAL APPLICABILITY

The alloy according to the present invention can be widely applied as a soft magnetic material used in power transformers, high-frequency transformers, components of various kinds of magnetic equipment, magnetic shields and the like.

What is claimed is:

1. An Fe-based amorphous alloy having excellent soft magnetic properties comprising, in at. %, Fe: 78 to 86%, P: 6 to 20%, C: 2 to 10%, and both of Si: 0.1 to 5% and Al: 0.1 to 3% in a total of 0.2 to 5%, and a balance of unavoidable impurities.

2. An Fe-based amorphous alloy having excellent soft magnetic properties comprising the composition of the Fe-based amorphous alloy of claim 1 and further comprising, in at. %, B: 1 to 18%.

3. An Fe-based amorphous alloy having excellent soft magnetic properties comprising the composition of the Fe-based amorphous alloy of claim 1, wherein Fe is replaced within the range of 30 at. % or less with at least one of Ni, Cr and Co.

* * * * *